US006085887A

United States Patent [19]

Bohringer

[11] Patent Number: 6,085,887

[45] Date of Patent: Jul. 11, 2000

[54] COIN AND/OR CARD-OPERATED DEPOSIT LOCK

[76] Inventor: Rainer Bohringer, Daimlerstrasse 10, D-74252 Massenbachhausen, Germany

[21] Appl. No.: 09/101,263

[22] PCT Filed: Dec. 20, 1996

[86] PCT No.: PCT/EP96/05788

§ 371 Date: Sep. 11, 1998

§ 102(e) Date: Sep. 11, 1998

[87] PCT Pub. No.: WO97/25693

PCT Pub. Date: Jul. 17, 1997

[30] Foreign Application Priority Data

Jan. 5, 1996 [DE] Germany ..... 196 00 248

[51] Int. Cl.[7] ..... G07F 7/00

[52] U.S. Cl. ..... 194/212; 194/905

[58] Field of Search ..... 194/905, 205, 194/212

[56] References Cited

U.S. PATENT DOCUMENTS

| | | | |
|---|---|---|---|
| 4,637,507 | 1/1987 | Ricouard et al. | 194/905 |
| 5,199,544 | 4/1993 | Lenander et al. | 194/905 |
| 5,573,098 | 11/1996 | Widmer | 194/212 |

FOREIGN PATENT DOCUMENTS

| | | | |
|---|---|---|---|
| 0468088 | 1/1992 | European Pat. Off. . | |
| 0572879 | 12/1993 | European Pat. Off. . | |
| 0577472 | 1/1994 | European Pat. Off. . | |
| 2645306 | 10/1990 | France . | |
| 2276482 | 9/1994 | United Kingdom . | |
| 82/01950 | 6/1982 | WIPO | 194/905 |
| 8801084 | 2/1988 | WIPO . | |
| 9007167 | 6/1990 | WIPO . | |
| 9013098 | 11/1990 | WIPO . | |
| 9322750 | 11/1993 | WIPO . | |

*Primary Examiner*—Robert P. Olszewski
*Assistant Examiner*—Bryan Jaketic
*Attorney, Agent, or Firm*—Pauley Petersen Kinne & Fejer

[57] ABSTRACT

A deposit lock for interconnection of shopping or luggage trolleys or the like, having a housing attachable to the shopping trolley and having on one side an opening for inserting a coupling member and on the other side a opening for inserting a coin and/or a card. An inside of said housing has a holding device for fixing the coupling member in position and a receiving device for secure enclosure of the inserted coin or card, and a release mechanism which releases the coupling member when the coin or card is inserted, and releases the coin or card when the coupling member is inserted. The deposit lock operates in a reliable manner because the release mechanism has a rocker with a swivel pin oriented transversely with respect to the direction of insertion of the coupling member or the coin or card and parallel to the plane of the coin or card, and by inserting the coin or card the rocker can be pivoted in the one direction in which the holding device releases the coupling member, and by inserting the coupling member the rocker can be pivoted in the other direction in which the receiving device releases the coin or card.

19 Claims, 1 Drawing Sheet

COIN AND/OR CARD-OPERATED DEPOSIT LOCK

BACKGROUND OF THE INVENTION

1. Field of the Invention

This invention relates to a deposit lock for coupling together shopping or baggage carts, or the like, having a housing which can be attached to the shopping cart, which on one side has an insertion opening for a coupling member and on the other side an insertion opening for a coin and/or a card, and which has in an interior a holding device for fixing the coupling member in place and a receiving device for secure locking of the inserted coin or card, as well as a release mechanism, which releases the coupling member when the coin or card is inserted, and releases the coin or the card, when the coupling member is pushed in the receiving device.

2. Description of Prior Art

A deposit lock of this type is taught by European Patent Reference EP 0 572 879 A2. In this known deposit lock a control element is moved during insertion of the card or coin, which moves a locking bolt from a blocking into an unblocked position. The locking bolt is rotatable and is connected via a crank gear with the control element in the form of a slide or a carriage.

According to this invention, it is one object to make available a deposit lock of the type mentioned above, having a different design, which assures the dependable securing of the coupling member, or respectively of the inserted coin or card.

This object is attained with the steps recited in the specification and in the claims. In accordance with this invention, the releasing mechanism has a rocker with a pivot shaft, which is oriented transversely with respect to the insertion direction of the coupling member, or respectively the coin or card, and parallel with respect to a plane of the coin or card. By introducing the coin or card the rocker can be pivoted in the one direction, wherein the holding device releases the coupling member, and can be pivoted in the other direction by inserting the coupling member, wherein the receiving device releases the coin, or respectively card.

A dependable operation of the locking mechanisms with a central element in the form of the rocker is achieved with a release mechanism designed in this way. At the same time it is possible to operate further control elements for refining the functional process and of the locking mechanisms.

If the holding device is designed as a catch hook arranged on the rocker on the side of the pivot shaft facing the coupling member which, with no coin or card inserted, engages an arresting section of the coupling member from above or below or from the side, wherein the rocker is maintained in the assigned pivot position by a spring force, the holding device for the coupling element is simply designed, wherein a dependable function is assured.

In the uncoupled state, in the position securely enclosing the coin or the card, the rocker is dependably maintained because while inserting the coin or the card a bolt is moved in the insertion direction, which itself has an arresting piece, or which operates one, which in the inserted state of the coin or the card comes into operative contact with a counter-piece of the rocker and supports the rocker against the pivot direction caused by the spring force in such a way that the coupling member is released. Only a simply designed and operable bolt is needed for this purpose. In this connection, advantageously, the slide supports the rocker on a side of the rocker facing the insertion opening of the coin, or respectively card, with respect to the pivot shaft, and the slide has a section projecting to the other side, facing the coupling member with respect to the pivot shaft, whose front area comes into connection with the coupling member. Thus the rocker is securely maintained in the uncoupling position. For re-coupling, it is only necessary to slightly push the bolt with the coupling member back, whereafter the holding device of the coupling member snaps closed and the coupling member is securely held.

The coupling member is dependably released when the coin or card is inserted, and is dependably fixed in position when the coupling member is inserted. In the fixed-in-place state of the coupling member, the slide is seated under spring prestress supported on the rocker in such a way that, when the coin or card is inserted and the rocker is pivoted, it is released from the support and is driven in the direction toward the coupling member and moves the latter at least partially out of the housing after release by the holding device. When the coupling member is inserted, the slide is pushed back against the spring force and releases the rocker for pivoting in accordance with its spring prestress.

If blocking elements, which are matched to the coupling member, are provided in the insertion opening of the coupling member, by means of which the push-back of the slide by other means is prevented, the rocker is secure against unauthorized release, for example with a flat object, so that the coin or card cannot be easily removed without authorization. Therefore the coupling member has the function of a real key.

The design of the deposit lock in a manner that, for pivoting the rocker by means of the coin or card, a carriage with at least one detent for the card and at least one actuation shoulder for the coin is provided. The rocker has at least one sloped inlet acting counter to the displacement direction of the displacement element, which cooperates with matched counter-slopes of the carriage in such a way that while displacing the carriage in the insertion direction of the coin or card the rocker is pivoted against the spring force, resulting in a simple operation and dependable function with few parts.

In this case it is also advantageous for a simple design if the detents for the card are arranged on the side of the carriage, which faces away from the rocker, on its front area in the insertion direction of the coin or card, and the actuation shoulders for the coin are arranged on the side of the carriage, which faces the rocker, in its rear area. The card slot and the coin slot are preferably arranged on the sides of the carriage corresponding to the detents, or respectively the actuation shoulders.

The unauthorized release of the coupling member and uncoupling of carts is made more difficult because the housing has at least one bolt blocking the carriage against displacement. When the card or coin is inserted into the housing, the bolts are brought into a position in which the carriage is released for displacement. The bolts can be easily moved by inserting the card or coin if provided. The bolts are seated pivotable around axes which are vertical with respect to the insertion plane of the card, or respectively coin, and are pushed inward by means of a spring force in such a way that the carriage is blocked by bolt pins provided on the bolts. The bolts have shoulder pieces and shoulder elements, by which they can be pivoted outward against the spring effect by the card, or respectively the coin, when they are inserted, so that the bolt pins release the carriage for displacement.

The housing of the actuating elements and therefore the simple design of the deposit lock is preferred with the rocker having two front legs, or respectively rear legs, in front of and behind the pivot shaft in the insertion direction of the coin, or respectively card. The holding pieces for enclosing the card and holding elements for enclosing the coin are attached in the receiving device in the area of the rear legs which is in the back in the insertion direction, vertically with respect to the plane of the coin, or respectively card, protruding away in the direction toward the coin, or respectively the card, wherein the inserted coin, or respectively card, is gripped from the rear at its rear edge when the coupling member is removed and the rocker is pivoted against the spring force.

Regarding the structure and production of the deposit lock, it is advantageous when the carriage is snapped into guides on the insides of the lateral housing walls, and the pivot shaft is snapped in bearings of the lateral housing walls.

BRIEF DESCRIPTION OF THE DRAWINGS

This invention will be explained in more detail by means of an exemplary embodiment, making reference to the drawings wherein.

DESCRIPTION OF PREFERRED EMBODIMENTS

Figure 1:
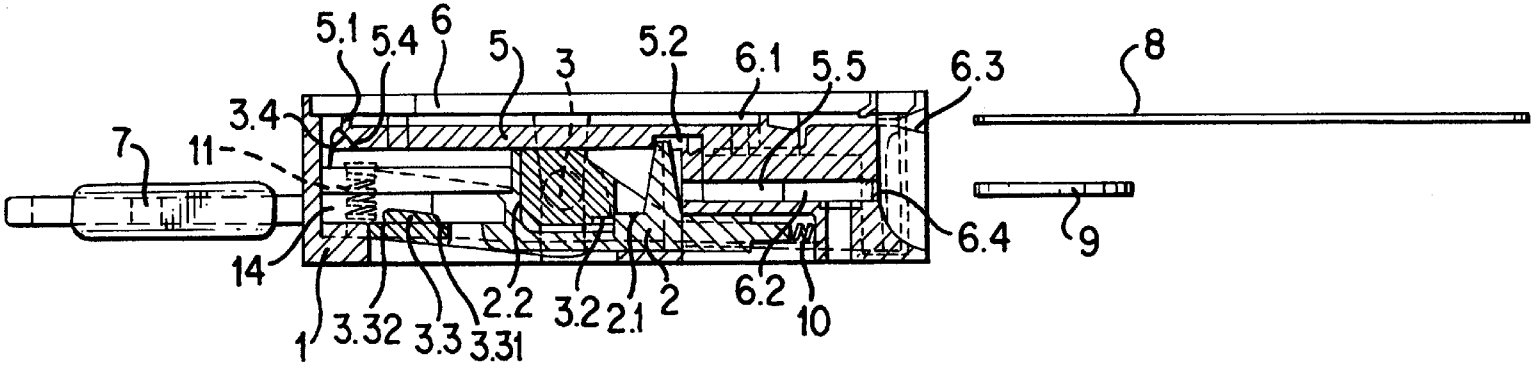
FIG. 1 is a side view in partial section of the deposit lock, as well as a coupling member, a card and a coin.

The deposit lock shown in a sectional side view in FIG. 1 and in a top view in FIG. 2 has a housing 1, a rocker 3 and a carriage 5 arranged above the housing 1 and a slide 2 arranged below the housing 1. The rocker 3 is seated at its approximate center on a pivot shaft 3.1, which is fixed in place in both longitudinal lateral walls of the cuboid housing 1, for example by being snapped in or by means of screws. As shown in FIG. 2, on the left side of the pivot shaft 3.1 in the representation, the rocker 3 has two front legs 3.5, and on the right side of the pivot shaft 3.1 the rocker 3 has two rear legs 3.6. The rocker 3 is resiliently supported against downward pivoting by means of a rocker spring 11 underneath the front legs 3.5.

The rocker 3 has a forward oriented section in its lower area between the front legs 3.5, which has on its front free end a catch hook 3.3 with a deflection slope 3.32 provided at the end, and on the side of the deflection slope 3.32 facing away from the free end the rocker 3 has a holding shoulder 3.31. Inlet slopes 3.4 facing away from the free end are respectively provided at the tops of the front legs 3.5. Upward protruding holding pieces 3.7 for a card 8, as well as holding elements 3.8 for a coin 9 are provided on the rear area of the rear legs 3.6. In the lower, rear area in the center of the rocker 3 a section is provided, which constitutes a counterpiece 3.2 for an arresting piece 2.1 of the slide 2.

The catch hook 3.3 of the rocker 3 projects into the free space of an insertion opening 14 embodied in the housing 1 for a key-like coupling member 7. An arresting section 7.1 is cut out of the coupling member 7, which is engaged by the catch hook 3.3 in the inserted state of the coupling member 7, i.e. when the front legs 3.5 are pivoted upward by the spring force of the rocker spring 11, so that the arresting holding shoulder 3.31 secures the coupling member 7 against being pulled out.

The slide 2 has a front area facing the inserted end area of the coupling member 7, which has an upwardly oriented protrusion 2.2, against which the coupling member 7 rests with its free end. The remaining area of the slide 2 extends backward underneath the pivot shaft 3.1, and is arranged approximately centered between the front legs 3.5 and the rear legs 3.6 and is seated, guided in the housing 1. The slide 2 is supported on its back on the housing by means of a slide spring 10, so that it is prestressed under pressure against the coupling member 7.

Figure 2:
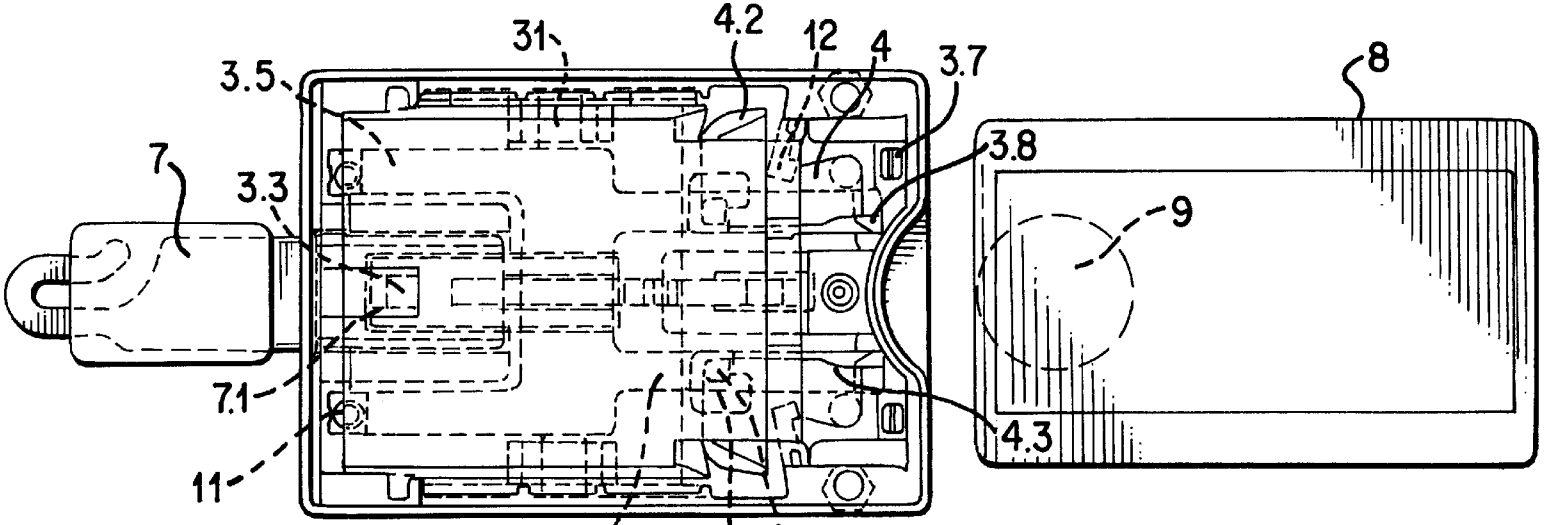
FIG. 2 is a top view of the deposit lock shown in FIG. 1.

When the front legs 3.5 of the rocker 3 are pivoted upward, the slide 2 is supported by means of the arresting piece 2.1 on the rocker 3, which can be seen in FIG. 1.

The carriage 5 is seated, displaceable in the longitudinal direction of the housing 1, arranged in the longitudinal lateral walls of the housing 1 above the rocker 3. On its left front in the drawing figure, the carriage 5 has on the bottom a counterslope 5.4 matched to the inlet slope 3.4 of the rocker 3, and in addition in its front area the carriage 5 has at least one upwardly projecting detent 5.1 for the card 8 inserted through an insertion opening 6.3 of the housing 1 into a card slot 6.1. The card slot 6.1 is embodied at the top of the housing 1 and can, for example, be closed toward the top of the housing 1 by means of a cover, which can be placed into a cover receptacle 6 of the housing 1. The carriage 5 can be snapped through outwardly and upwardly extending slopes of the lateral walls of the housing 1, for example, into grooves formed thereunder on the lateral walls of the housing 1, or the carriage 5 can be inserted in such grooves from the rear or front of the housing 1. In its rear area, on the underside oriented toward the rocker 3, the carriage 5 has downwardly projecting actuation shoulders 5.5, which laterally project into the area of a coin slot 6.2 in such a way that the shoulder 5.5 constitute a detent for the coin 9 to be inserted through an appropriate insertion opening 6.4 of the housing 1.

In its rear section on the underside, the carriage 5 furthermore has a cutout 5.2, into which a upwardly extending projection of the slide 2 extends in order to limit the pushing back of the carriage 5, if required. Also in its rear section 2, essentially angle-shaped cutouts 5.3 are provided in the carriage 5, into which upwardly projecting bolt pins 4.1 of bolts 4, arranged on both sides, extend. The two bolts 4 are seated, pivotable around vertical axes, and are supported on the longitudinal lateral walls of the housing 1 by means of bolt springs 12, so that they are pushed toward the rear and are supported by their bolt pins 4.1 in the rear lateral walls of the cutouts 5.3 of the carriage 5, which are offset toward the front, and lock the latter against being pushed forward. This is the state in which the coupling member 7 is inserted and the front legs 3.5 of the rocker 3 are pivoted up, and the card 8 as well as the coin 9 are not inserted.

To release the coupling member 7, either the coin 9 is pushed into the coin slot 6.2, or the card 8 is pushed into the card slot 6.1. The bolts 4 are grasped by the coin 9 at the inwardly projecting shoulder elements 4.3, and in the course of the continued insertion of the coin 9, the two bolts 4 are pivoted outward, so that the bolt pins 4.1 are pivoted away from the offset rear walls of the cutouts 5.3. By pushing the coin 9 further in, it pushes against the downward projecting actuating slopes 5.5 of the carriage 5, so that the carriage 5 slides forward. In the process, with its counter-slopes 5.4 located at the front the carriage 5 pushes against the inlet slope 3.4, so that the rocker 3 is downwardly pivoted with its front legs 3.5 against the rocker spring 11. As a result, the catch hook 3.3 releases the coupling member 7. Furthermore, the slide 2 no longer rests against the rocker 3, but instead is pushed forward by the force of the bolt spring 12, so that the coupling member 7 is pushed out by the protrusion 2.2 of the slide 2, while the arresting piece 2.1 of the slide 2 is pushed underneath the counter-piece 3.2 of the rocker 3. Furthermore, the rear legs 3.6 are pivoted upward and, by means of the holding elements 3.8, which are pushed forward behind the rear edge of the coin 9, prevent the coin 9 from being removed.

A displacement corresponding to the above displacement of the carriage 5 can also be accomplished by means of the card 8, when the latter is inserted through the insertion opening 6.3 into the card slot 6.1. With its front edge the inserted card 8 pushes against the detent 5.1 of the carriage 5, so that the carriage 5 is pushed forward and with its counter-slope pushes the rocker 3 downward via the inlet slope 3.4. The coupling member 7 is released by the downward pivoting of the front legs 3.5 and therefore also of the catch hook 3.3. Here, too, the slide 2 is pushed forward by means of the slide spring 10 and pushes the coupling member 7 out. The rocker 3 is also blocked against pivoting upward by means of the arresting piece 2.1. During the downward pivoting of the front legs 3.5 of the rocker 3, the rear legs 3.6 are pivoted upward, so that by means of the holding pieces 3.7 the card 9 is secured against being taken out. During insertion of the card 9, the bolts 4 are moved outward because the card 9 works together with the shoulder pieces 4.2.

The coupling member 7 is inserted to release the coin 8, or respectively the card 9. In the course of the insertion the slide 2 is pushed against the prestress of the slide spring 10 at the protrusion 2.2 toward the back by contact with the end area to be inserted of the coupling member 7, so that the arresting piece 2.1 is pushed out from under the counter-piece 3.2 of the rocker 3. Because of this the rocker 3 pivots upward with the front legs 3.5 in accordance with the force of the rocker spring 11. The catch hook 3.3 enters the arresting section 7.1 of the coupling member 7, so that the coupling member 7 is held by means of the holding shoulder 3.31. The carriage 5 slides backward against the insertion direction of the coin 9 or the card 8, either by means of the cooperation between the inlet slope 3.4 and the counter-slope 5.4, or by means of an additional spring. During the upward pivoting of the front legs 3.5, the rear legs 3.6 pivot down correspondingly, so that the holding elements 3.8 of the rocker 3 release the rear edge of the coin 9 and it can be taken out. Correspondingly, the card 8 is released by the downward pivoting of the holding pieces 3.7 and can be removed.

To prevent the coin 9, or respectively the card 8, from being removed without authorization by manipulation with an element introduced into the insertion opening 14 and by pivoting the rocker 3 down when the coupling member 7 is removed from the housing 1, the slide 2 can advantageously be secured, for example by means of resiliently seated hook elements arranged laterally in the insertion opening. In this case the coupling member 7 is embodied accordingly for pushing the hook elements back in the manner of a key operation and for releasing the slide 2.

The coin 9, or respectively the card 8, can also be made secure against removal by deflection mechanisms different from those described, having laterally pivotable or displaceable holding elements, wherein these elements are actuated by means of the rocker 3.

In a preferred embodiment the coin 9, or respectively the card 8, is already blocked during the first third of the pivot movement of the rocker 3, while the coupling member 7 also remains blocked. The coupling member 7 is released during the last third of the pivot movement of the rocker 3. When the coupling member 7 is inserted, it is already blocked while the card 8, or respectively coin 9 are still blocked. Subsequently the card 8, or respectively the coin 9 are released by the further pivot movement of the rocker 3.

The deposit lock can be arranged in various positions on the cart to be secured. In the process the attachment of the housing 1 in a correspondingly matched outer holding device is easily possible and practical.

I claim:

1. In a deposit lock for coupling together shopping or baggage carts, having a housing (1) which can be attached to the shopping cart, which on one side has a first insertion opening (14) for a coupling member (7) and on the other side a second insertion opening for at least one of a coin (9) and a card (8), and which has in an interior a holding device (3.3, 3.31) for fixing the coupling member (7) in place and a receiving device for the secure locking of the inserted at least one of the coin (9) and the card (8), and a release mechanism (3), which releases the coupling member (7) when the at least one of the coin (9) and the card (8) is inserted, and releases the at least one of the coin (9) and the card (8), when the coupling member (7) is pushed in, the improvement comprising:

the releasing mechanism (3) having a rocker (3) with a pivot shaft (3.1) which is oriented transversely with respect to one of an insertion direction of the coupling member (7) and the at least one of the coin (9) and the card (8) and parallel with a plane of the at least one of the coin (9) and the card (8) and with a plurality of sections (3.5, 3.6,) arranged on both sides of the pivot shaft (3.1), and that by action of the at least one of the coin (9) and the card (8) on one section (3.6) of the sections (3.5, 3.6) the rocker (3) can be pivoted in one direction, wherein the holding device (3.3, 3.31) releases the coupling member (7), and by action of the coupling member (7) on another section (3.5) of the sections (3.5, 3.6) while being inserted can be pivoted in another direction wherein the receiving device (6.1, 3.7, 6.2, 3.8) releases the at least one of the coin (9) and the card (8);

the holding device (3.3, 3.31) is designed as a catch hook (3.3) arranged on the rocker (3) on the side of the pivot shaft (3.1) facing the coupling member (7) which without the at least one of the coin (9) and the card (8) inserted engages an arresting section (7.1) of the coupling member (7) and the rocker (3) is maintained in the assigned pivot position by a spring force; and in the course of inserting the at least one of the coin (9) and the card (8), a slide (2) is moved in the insertion direction, the slide (2) has an arresting piece (2.1) which in the inserted state comes into operative contact with a counter-piece (3.2) of the rocker (3) and supports the rocker (3) against a pivot direction caused by the spring force in such a way that the coupling member (7) is released, wherein the slide (2) supports the rocker (3) on a side of the rocker (3) facing the insertion opening with respect to the pivot shaft (3.1), and the slide (2) has a section projecting to another side facing the coupling member (7) with respect to the pivot shaft (3.1), and a front area (2.2) that comes into connection with the coupling member (7).

2. In the deposit lock in accordance with claim 1 wherein in a fixed state of the coupling member (7), the slide (2) is seated under a spring prestress in the insertion direction while being supported on the rocker (3) so that when the at least one of the coin (9) and the card (8) is inserted and the rocker (3) is pivoted, the slide (2) is released from the support and is driven toward the coupling member (7) and moves the coupling member (7) at least partially out of the housing (1) after release by the holding device (3.3, 3.31), and when the coupling member (7) is inserted the slide (2) is pushed against the spring force and releases the rocker (3) for pivoting according to a spring prestress.

3. In the deposit lock in accordance with claim 2, wherein a plurality of blocking elements which are matched to the coupling member (7) are provided in the insertion opening (14) of the coupling member (7), by means of which push-back of the slide (2) is prevented.

4. In the deposit lock in accordance with claim 3, wherein there is for pivoting the rocker (3) a carriage (5) with at least one detent (5.1) for the card (8) and at least one actuation shoulder (5.5) for the coin (9), and the rocker (3) has at least one sloped inlet (3.4) acting counter to a displacement direction of a displacement element (5) which cooperates with matched counter-slopes (5.4) of the carriage (5) so that while displacing the carriage (5) in the insertion direction the rocker (3) is pivoted against the spring force.

5. In the deposit lock in accordance with claim 4, wherein the at least one detent (5.1) for the card (8) is arranged on the side of the carriage (5), which faces away from the rocker (3), on the front area in the insertion direction, and the at least one actuation shoulder (5.5) is arranged on the side of the carriage (5), which faces the rocker (3), in a rear area, and a card slot (6.1) and a coin slot (6.2) are arranged on the sides of the carriage (5) corresponding to the detents (5.1) and the actuation shoulders (5.5).

6. In the deposit lock in accordance with claim 5, wherein the housing (1) has at least one bolt (4) with elements (4.1) blocking the carriage against displacement, and when the at least one of the coin (9) and the card (8) is inserted into the housing (1) the bolts (4) are positioned so that the carriage (5) is released for displacement.

7. In the deposit lock in accordance with claim 6, wherein the bolts (4) are seated pivotable around axes which are vertical with respect to the insertion plane of the at least one of the coin (9) and the card (8) and are pushed inward by a spring force so that the carriage (5) is blocked by the bolt pins (4.1), and the bolts (4) have shoulder pieces (4.2) and shoulder elements (4.3) by which the bolts (4) can be pivoted outward against the spring effect by the at least one of the coin (9) and the card (8) when inserted so that the bolt pins (4.1) release the carriage (5) for displacement.

8. In the deposit lock in accordance with claim 7, wherein the rocker (3) has one of two front legs (3.5) and rear legs (3.6) near the pivot shaft (3.1) in the insertion direction, holding pieces (3.7) for enclosing the card (8) and holding elements (3.8) for enclosing the coin (9) are attached in the receiving device (6.1, 6.2) in an area of the rear legs (3.6) vertically with respect to the plane protruding away toward the at least one of the coin (9) and the card (8), wherein the inserted at least one of the coin (9) and the card (8) is gripped at a rear edge when the coupling member (7) is removed and the rocker (3) is pivoted against the spring force.

9. In the deposit lock in accordance with claim 8, wherein the carriage (5) is snapped into guides on insides of lateral housing walls of the housing (1).

10. In the deposit lock in accordance with claim 1, wherein a plurality of blocking elements which are matched to the coupling member (7) are provided in the insertion opening (14) of the coupling member (7), by means of which push-back of the slide (2) is prevented.

11. In the deposit lock in accordance with claim 4, wherein the housing (1) has at least one bolt (4) with elements (4.1) blocking the carriage against displacement, and when the at least one of the coin (9) and the card (8) is inserted into the housing (1) the bolts (4) are positioned so that the carriage (5) is released for displacement.

12. In the deposit lock in accordance with claim 11, wherein the bolts (4) are seated pivotable around axes which are vertical with respect to the insertion plane of the at least one of the coin (9) and the card (8) and are pushed inward by a spring force so that the carriage (5) is blocked by the bolt pins (4.1), and the bolts (4) have shoulder pieces (4.2) and shoulder elements (4.3) by which the bolts (4) can be pivoted outward against the spring effect by the at least one of the coin (9) and the card (8) when inserted so that the bolt pins (4.1) release the carriage (5) for displacement.

13. In the deposit lock in accordance with claim 1, wherein a carriage (5) is snapped into guides on insides of lateral housing walls of the housing (1).

14. In a deposit lock for coupling together shopping or baggage carts, having a housing (1) which can be attached to the shopping cart, which on one side has a first insertion opening (14) for a coupling member (7) and on the other side a second insertion opening for at least one of a coin (9) and a card (8), and which has in an interior a holding device (3.3, 3.31) for fixing the coupling member (7) in place and a receiving device for the secure locking of the inserted at least one of the coin (9) and the card (8), and a release mechanism (3), which releases the coupling member (7) when the at least one of the coin (9) and the card (8) is inserted, and releases the at least one of the coin (9) and the card (8), when the coupling member (7) is pushed in, the improvement comprising:

the releasing mechanism (3) having a rocker (3) with a pivot shaft (3.1) which is oriented transversely with respect to one of a insertion direction of the coupling member (7) and the at least one of the coin (9) and the card (8) and parallel with a plane of the at least one of the coin (9) and the card (8) and with a plurality of sections (3.5, 3.6) arranged on both sides of the pivot shaft (3.1), and that by action of the at least one of the coin (9) and the card (8) on one section (3.6) of the sections (3.5, 3.6) the rocker (3) can be pivoted in one direction, wherein the holding device (3.3, 3.31) releases the coupling member (7), and by action of the coupling member (7) on another section (3.5) of the sections (3.5, 3.6) while being inserted can be pivoted in another direction wherein the receiving device (6.1, 3.7, 6.2, 3.8) releases the at least one of the coin (9) and the card (8), wherein in the course of inserting the at least one of the coin (9) and the card (8) a slide (2) is moved in the insertion direction, the slide (2) has an arresting piece (2.1) which in the inserted state comes into operative contact with a counter-piece (3.2) of the rocker (3) and supports the rocker (3) against a pivot direction caused by a spring force in such a way that the coupling member (7) is released.

15. In the deposit lock in accordance with claim 14, wherein the slide (2) supports the rocker (3) on a side of the rocker (3) facing the insertion opening with respect to the pivot shaft (3.1), and the slide (2) has a section projecting to another side facing the coupling member (7)

with respect to the pivot shaft (3.1), and a front area (2.2) that comes into connection with the coupling member (7).

16. In the deposit lock in accordance with claim 15, wherein in a fixed state of the coupling member (7), the slide (2) is seated under a spring prestress in the insertion direction while being supported on the rocker (3) so that when the at least one of the coin (9) and the card (8) is inserted and the rocker (3) is pivoted, the slide (2) is released from the support and is driven toward the coupling member (7) and moves the coupling member (7) at least partially out of the housing (1) after release by the holding device (3.3, 3.31), and when the coupling member (7) is inserted the slide (2) is pushed against the spring force and releases the rocker (3) for pivoting according to a spring prestress.

17. In a deposit lock for coupling together shopping or baggage carts, having a housing (1) which can be attached to the shopping cart, which on one side has a first insertion opening (14) for a coupling member (7) and on the other side a second insertion opening for at least one of a coin (9) and a card (8), and which has in an interior a holding device (3.3, 3.31) for fixing the coupling member (7) in place and a receiving device for the secure locking of the inserted at least one of the coin (9) and the card (8), and a release mechanism (3), which releases the coupling member (7) when the at least one of the coin (9) and the card (8) is inserted, and releases the at least one of the coin (9) and the card (8), when the coupling member (7) is pushed in, the improvement comprising:

the releasing mechanism (3) having a rocker (3) with a pivot shaft (3.1) which is oriented transversely with respect to one of a insertion direction of the coupling member (7) and the at least one of the coin (9) and the card (8) and parallel with a plane of the at least one of the coin (9) and the card (8) and with a plurality of sections (3.5, 3.6) arranged on both sides of the pivot shaft (3.1), and that by action of the at least one of the coin (9) and the card (8) on one section (3.6) of the sections (3.5, 3.6) the rocker (3) can be pivoted in one direction, wherein the holding device (3.3, 3.31) releases the coupling member (7), and by action of the coupling member (7) on another section (3.5) of the sections (3.5, 3.6) while being inserted can be pivoted in another direction wherein the receiving device (6.1, 3.7, 6.2, 3.8) releases the at least one of the coin (9) and the card (8), wherein there is for pivoting the rocker (3) a carriage (5) with at least one detent (5.1) for the card (8) and at least one actuation shoulder (5.5) for the coin (9), and the rocker (3) has at least one sloped inlet (3.4) acting counter to a displacement direction of a displacement element (5) which cooperates with matched counter-slopes (5.4) of the carriage (5) so that while displacing the carriage (5) in the insertion direction the rocker (3) is pivoted against the spring force.

18. In the deposit lock in accordance with claim 17, wherein the at least one detent (5.1) for the card (8) is arranged on the side of the carriage (5), which faces away from the rocker (3), on the front area in the insertion direction, and the at least one actuation shoulder (5.5) is arranged on the side of the carriage (5), which faces the rocker (3), in a rear area, and a card slot (6.1) and a coin slot (6.2) are arranged on the sides of the carriage (5) corresponding to the detents (5.1) and the actuation shoulders (5.5).

19. In a deposit lock for coupling together shopping or baggage carts, having a housing (1) which can be attached to the shopping cart, which on one side has a first insertion opening (14) for a coupling member (7) and on the other side a second insertion opening for at least one of a coin (9) and a card (8), and which has in an interior a holding device (3.3, 3.31) for fixing the coupling member (7) in place and a receiving device for the secure locking of the inserted at least one of the coin (9) and the card (8), and a release mechanism (3), which releases the coupling member (7) when the at least one of the coin (9) and the card (8) is inserted, and releases the at least one of the coin (9) and the card (8), when the coupling member (7) is pushed in, the improvement comprising:

the releasing mechanism (3) having a rocker (3) with a pivot shaft (3.1) which is oriented transversely with respect to one of a insertion direction of the coupling member (7) and the at least one of the coin (9) and the card (8) and parallel with a plane of the at least one of the coin (9) and the card (8) and with a plurality of sections (3.5, 3.6) arranged on both sides of the pivot shaft (3.1), and that by action of the at least one of the coin (9) and the card (8) on one section (3.6) of the sections (3.5, 3.6) the rocker (3) can be pivoted in one direction, wherein the holding device (3.3, 3.31) releases the coupling member (7), and by action of the coupling member (7) on another section (3.5) of the sections (3.5, 3.6) while being inserted can be pivoted in another direction wherein the receiving device (6.1, 3.7, 6.2, 3.8) releases the at least one of the coin (9) and the card (8), wherein the rocker (3) has one of two front legs (3.5) and rear legs (3.6) near the pivot shaft (3.1) in the insertion direction, holding pieces (3.7) for enclosing the card (8) and holding elements (3.8) for enclosing the coin (9) are attached in the receiving device (6.1, 6.2) in an area of the rear legs (3.6) vertically with respect to the plane protruding away toward the at least one of the coin (9) and the card (8), wherein the inserted at least one of the coin (9) and the card (8) is gripped at a rear edge when the coupling member (7) is removed and the rocker (3) is pivoted against the spring force.

* * * * *